US007905437B2

(12) United States Patent
Rota

(10) Patent No.: US 7,905,437 B2
(45) Date of Patent: Mar. 15, 2011

(54) WASTE SHREDDER COMPRISING AT LEAST TWO ROTORS

(75) Inventor: Fabio Rota, Milan (IT)

(73) Assignee: Satrind S.p.A., Arluno (Milano) (IT)

( * ) Notice: Subject to any disclaimer, the term of this patent is extended or adjusted under 35 U.S.C. 154(b) by 0 days.

(21) Appl. No.: 12/663,548

(22) PCT Filed: Mar. 3, 2008

(86) PCT No.: PCT/EP2008/001666

§ 371 (c)(1),
(2), (4) Date: Dec. 8, 2009

(87) PCT Pub. No.: WO2008/148434

PCT Pub. Date: Dec. 11, 2008

(65) Prior Publication Data

US 2010/0176233 A1 Jul. 15, 2010

(30) Foreign Application Priority Data

Jun. 8, 2007 (IT) ..... MI2007A1165

(51) Int. Cl.
*B02C 23/02* (2006.01)

(52) U.S. Cl. ..... 241/224; 241/242; 241/243

(58) Field of Classification Search ..... 241/224, 241/242, 243, 189.2
See application file for complete search history.

(56) References Cited

U.S. PATENT DOCUMENTS

| | | | | |
|---|---|---|---|---|
| 4,412,659 | A | 11/1983 | Crawford et al. | |
| 4,844,363 | A * | 7/1989 | Garnier et al. | 241/224 |
| 5,417,375 | A * | 5/1995 | Peterson et al. | 241/35 |
| 6,405,949 | B1 * | 6/2002 | Maguire | 241/30 |
| 2003/0089478 | A1 | 5/2003 | Tanner | |

FOREIGN PATENT DOCUMENTS

WO WO 2005/072877 A1 8/2005

OTHER PUBLICATIONS

International Search Report, dated Jul. 18, 2008, from corresponding PCT application.

* cited by examiner

*Primary Examiner* — Bena Miller
(74) *Attorney, Agent, or Firm* — Young & Thompson

(57) ABSTRACT

A waste shredder (1) includes at least one loading chamber (3), two or more rotors (4) placed in seats formed in the bottom wall of the loading chamber (3) and a movable hopper (2) sliding above the loading chamber (3) and provided with a reciprocating translational movement. The hopper (2) has two end walls (B, B') and carries a plurality of stiff vanes (5) placed in the spaces between the rotors (4), the end walls (B, B1) and the stiff vanes (5) protruding downward until they skim the bottom of the loading chamber (3) to press the material (8) to be shredded against the rotors (4). The rotors (4) turn in the opposite direction to the translational movement of the hopper (2) and reverse their direction of rotation when the hopper (2) reverses its direction of translation.

7 Claims, 8 Drawing Sheets

WASTE SHREDDER COMPRISING AT LEAST TWO ROTORS

The present invention refers to a shredder for waste (refuse, production waste, recyclable material, etc.), which comprises:

a supporting structure which carries a loading chamber;

two or more tool-carrying rotors, placed in seats formed in the bottom wall of the loading chamber;

a moveable hopper, sliding over the loading chamber and provided with a reciprocating translational movement, which has two end walls and which carries a plurality of stiff vanes placed in the space between the rotors: the end walls and the stiff vanes, protruding downward until they skim the bottom of the loading chamber, press the material to be shredded against the rotors.

The rotors turn in the opposite direction to the translational movement of the hopper and reverse their direction of rotation when the hopper reverses its direction of translation i.e. when the hopper translates in one direction (for example: from left to right) the rotors rotate in one direction (for example: counter clockwise) and vice versa.

In the treatment of the refuse—and in particular of the urban refuse (solid urban refuse and the like)—it is becoming increasingly and urgently necessary (or, at least, advisable) to subject the refuse, after an adequate selection and separation of the non combustible or otherwise manageable fractions, to a shredding process adapted to make the average dimensions of the remaining material small enough to facilitate use thereof as an alternative fuel in incinerators or cement works furnaces: in fact, the ease of feeding to the furnace and the possibility of homogenisation thus obtained constitute the necessary elements for a correct and profitable management of the combustion heat cycle.

Moreover, for said management of refuse to be economically viable it is necessary for the throughput of the system and in particular of the shredding section to ensure very high hourly rates, normally of the order of many tonnes/hour.

These throughputs are normally obtained nowadays with the use of machines that use single large or very large rotors, which have only one direction of rotation and of work and which lead to large installed powers and high investment costs.

However, this type of machines has the limitation that, when it is necessary to intervene for repairs or maintenance (which are generally very frequent precisely because of the type of work carried out), each intervention is particularly costly in economic and practical terms since it makes necessary for the whole shredding line to be put out of operation, normally for far from negligible periods.

In particular, in order to ensure the necessary high throughput rates, machines of the prior art have a rotor with a large diameter and length, which has a very large moment of inertia and can therefore be easily damaged by hard, unshreddable foreign bodies (easily present in refuse) which engage the cutting edges of the rotor, forcing the rotor to stop more or less instantly and causing frequent damages or breakages of the cutting tools.

In many cases, in order to avoid unacceptable interruptions of the service, a reserve machine is made available to replace the machine that is down for repair or for maintenance, considerably increasing the initial investment costs.

The need has therefore been felt to produce machines for shredding refuse that have such characteristics of simplicity of intervention and of cheapness as to allow the machine down times and costs to be drastically reduced, making the reserve machine superfluous.

The machine forming the subject matter of the present invention sets out to replace the machines of the prior art, consisting of a single shredding unit (comprising the rotor and the relative counter-blades) having a single cutting direction and a very high throughput per unit—and thus large or very large dimensions and powers—with a much easy-to-manage multi-rotor machine, consisting of a plurality of very small shredding units with two cutting directions.

Object of the present invention is to produce a waste shredder, comprising at least two rotors, that is adapted to overcome the limits presented by shredders of the prior art; this object is achieved by means of a waste shredder that has the characterising features illustrated in claim 1.

Further advantageous characteristics of the invention form the subject matter of the dependent claims.

The invention will now be described with reference to purely exemplifying (and therefore non limiting) embodiments illustrated in the appended figures, wherein.

In the appended figures corresponding elements will by designated by the same reference numerals.

Figure 1:
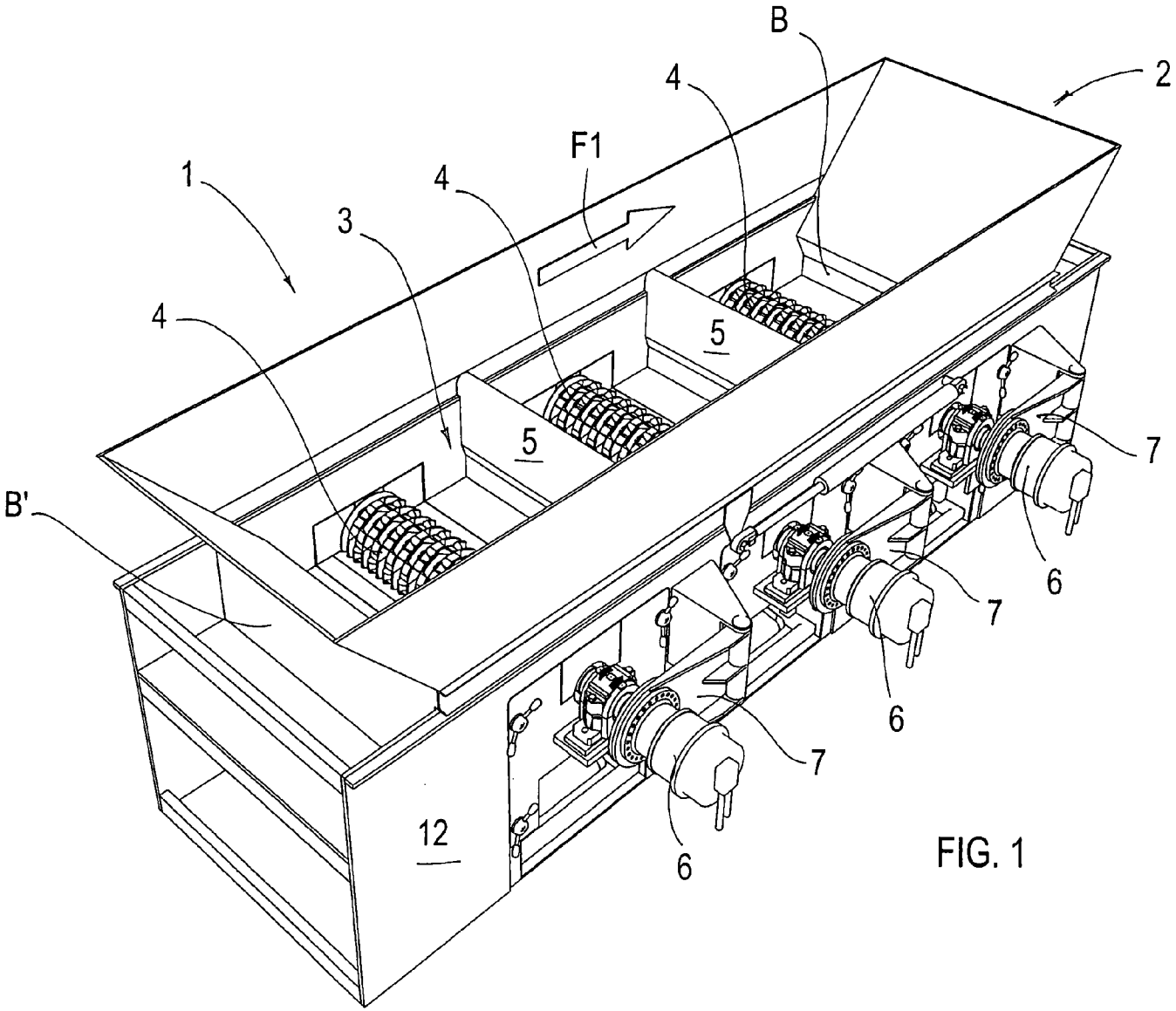
FIG. 1 shows diagrammatically a perspective view of a waste shredder, made according to the invention, comprising three rotors, with the hopper in an intermediate position.

FIG. 1 shows diagrammatically a perspective view of a waste shredder 1, made according to the invention, comprising three rotors 4, with the hopper 2 in an intermediate position, while it is translating as indicated by the arrow F1.

The waste shredder 1 comprises a supporting structure 12 which bears the loading chamber 3, three rotors 4 placed in seats formed in the bottom wall of the loading chamber 3 and a movable hopper 2, sliding over the loading chamber 3 and provided with a reciprocating translational movement, which has two end walls (B, B') and which carries a plurality of stiff vanes 5 placed in the spaces between the rotors 4: the end walls (B, B') of the hopper 2 and the vanes 5, protruding downwards until they skim the bottom of the loading chamber 3, press the material 8 to be shredded (omitted in FIG. 1) against the rotors 4, which rotate in the opposite direction to the translational movement of the hopper 2 (FIGS. 3-6), as disclosed above.

The material 8 to be shredded is gripped by the teeth of the rotors 4 and cut (in a per se known manner) against counter-blades, adjacent the rotors 4, omitted in the appended figures for the sake of simplicity of the graphic representation.

The rotors 4 reverse their direction of rotation when the hopper 2 reverses its direction of translation, as disclosed above.

Moreover, in FIG. 1 the motors 6 which drive the rotors 4 can be seen: each motor 6 is carried by supporting means 7 and is coupled to the shaft of one of the rotors 4 by means of riveted flanges or of another per se known rapid coupling/uncoupling means.

The use of hydraulic motors 6 to drive the rotors 4 proves advantageous since the hydraulic motors are adapted to stand the frequent changes in the direction of rotation required for operating the shredder 1 without presenting the drawbacks (for example, the overheating) presented by the electric motors in the same operating conditions.

In the embodiment described here, the waste shredder 1 comprises three rotors 4 and two vanes 5 integral with the movable hopper 2 but, without departing from the scope of the invention, the waste shredder 1 can comprise four rotors 4 and three vanes 5, five rotors and four vanes 5 and so on: the shredder 1 generally comprises n rotors 4 and n−1 vanes 5, with n a whole number of two or more.

Figure 2:
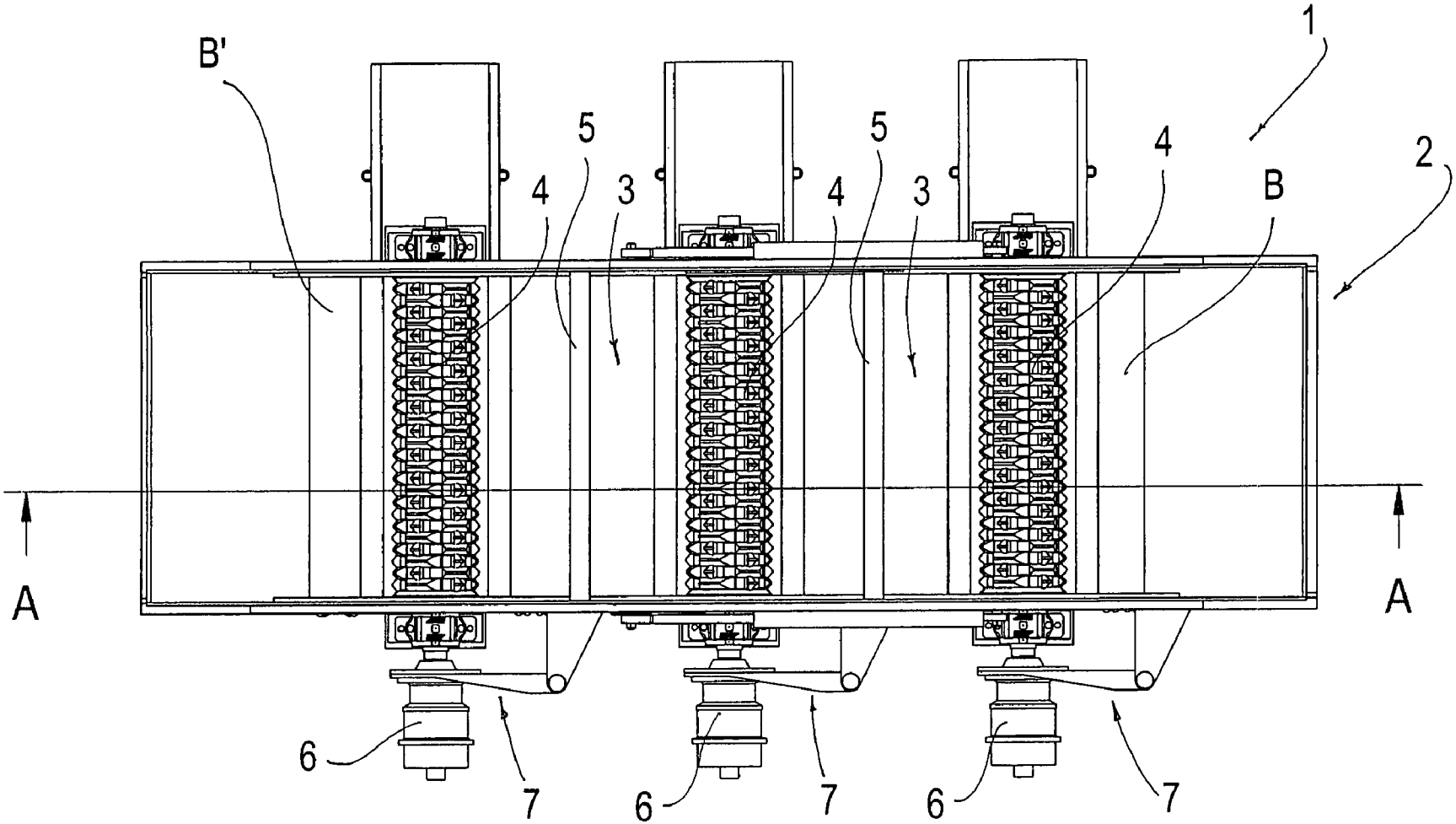
FIG. 2 shows diagrammatically a top view of the shredder of FIG. 1.

FIG. 2 shows diagrammatically, from above, the shredder 1 of FIG. 1; in FIG. 2 the loading chamber 3, the movable hopper 2, the end walls (B, B'), the vanes 5 and the rotors 4, coupled to the motors 6 and carried by the supporting means 7, can be seen.

Operation of the shredder 1 will now be described briefly with reference to FIGS. 3-6.

Figure 3:
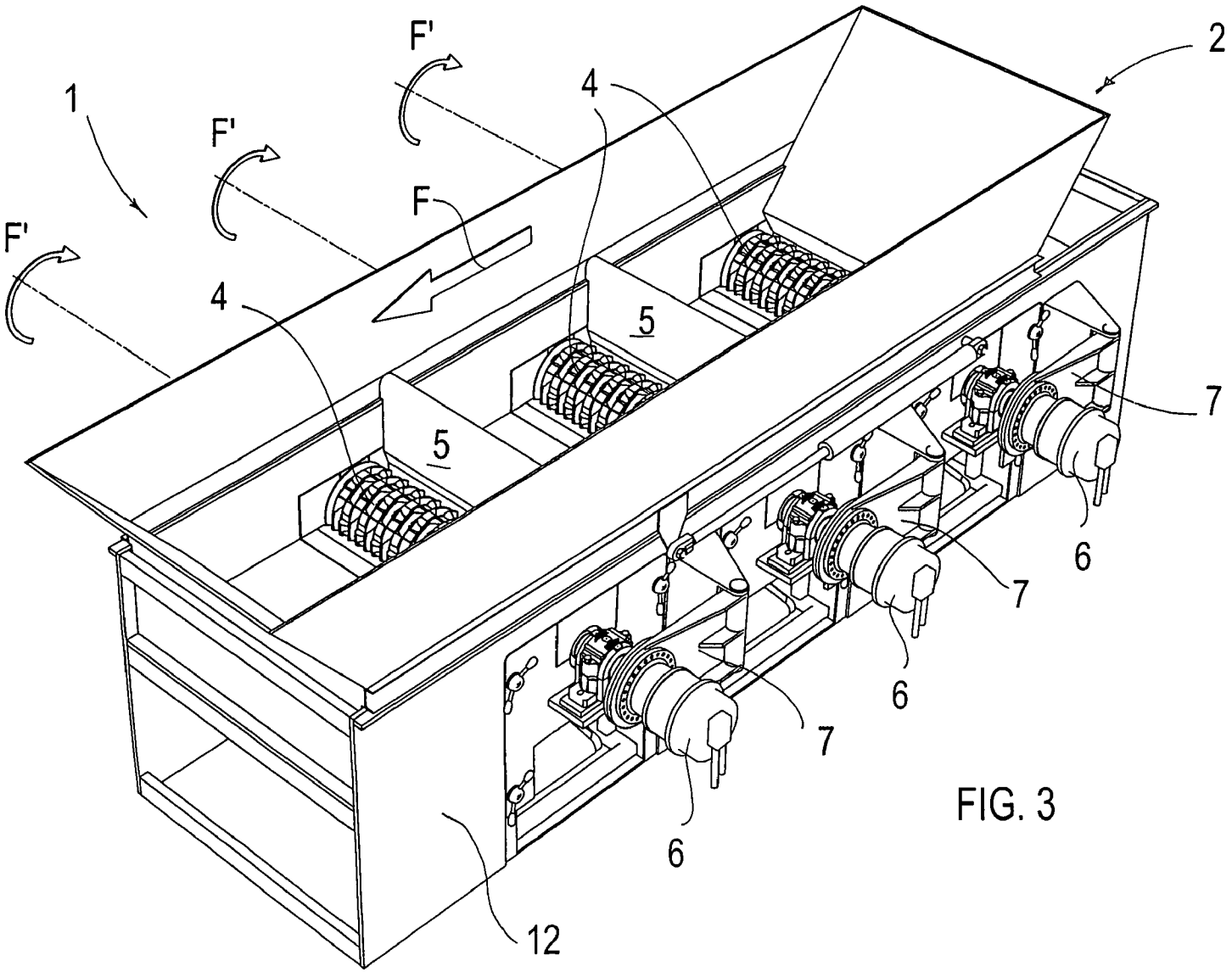
FIG. 3 shows diagrammatically a perspective view of the shredder of FIG. 1, with the hopper at one end of its translational movement.

FIG. 3 shows diagrammatically a perspective view of the shredder 1 of FIG. 1, with the hopper 2 that, by translating in the direction indicated by the arrow F in FIG. 3, has reached one end of its translational movement.

Figure 5:
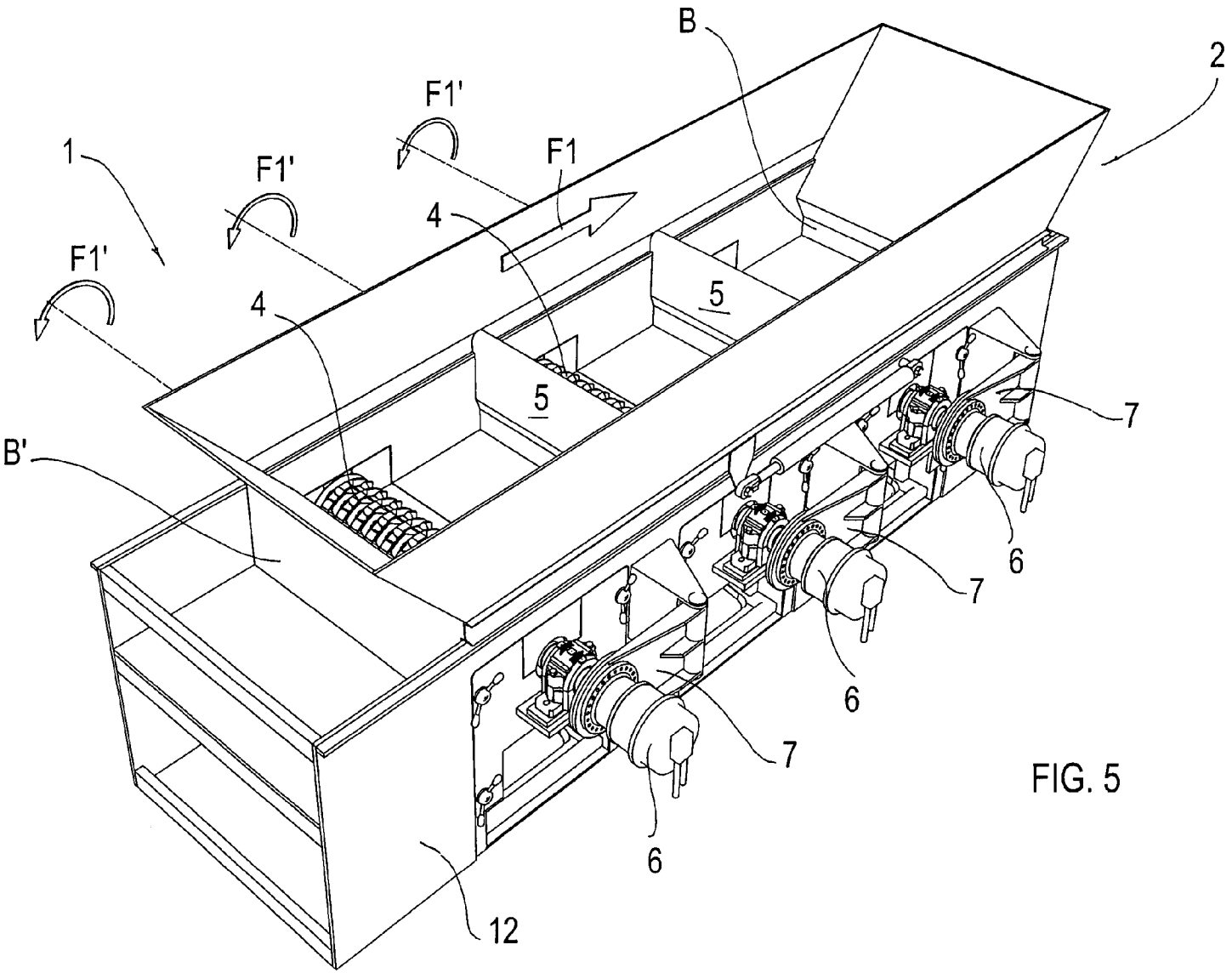
FIG. 5 shows diagrammatically a perspective view of the shredder of FIG. 1, with the hopper at the other end of its translational movement.

As mentioned previously, the hopper 2 has a reciprocating translational movement, which makes it pass alternately from the position shown in FIG. 3 to that shown in FIG. 5 and vice versa.

Figure 4:
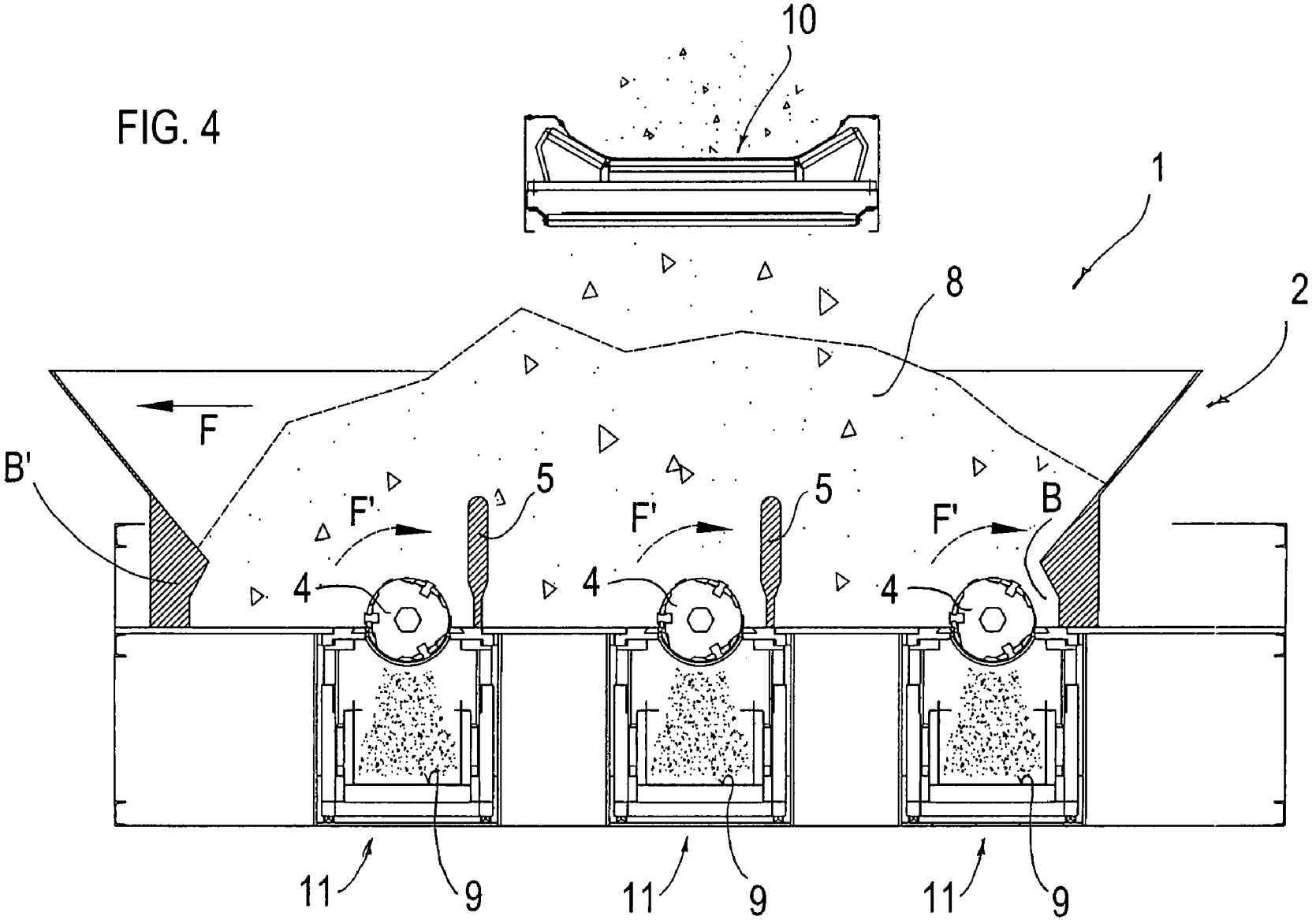
FIG. 4 shows diagrammatically the shredder of FIG. 3 sectioned along the plane A-A of FIG. 1.

With reference to the FIGS. 3 and 4 (the last showing diagrammatically the shredder 1 of FIG. 3 sectioned along the plane A-A of FIG. 1), while the hopper 2 (which carries the vanes 5) is moving in the direction of the arrow F the vanes 5 (which move in the same direction; FIG. 4) and the end wall B of the hopper 2 press the material 8 to be shredded against the rotors 4, which rotate in the opposite direction to the translational movement of the hopper 2 to grip the material 8 and to cut it against the counter-blades.

In the FIGS. 3 and 4 the direction of rotation of the rotors 4 is indicated by the arrows F'.

The shredder 1 is normally fed by means of a conveyor belt 10: the reciprocating movement of the hopper 2 distributes the material 8 over the whole surface of the loading chamber 3, allowing a balanced operation of the shredding units 11 (FIG. 7), comprising at least a rotor 4 and the respective counter-blades.

Figure 6:
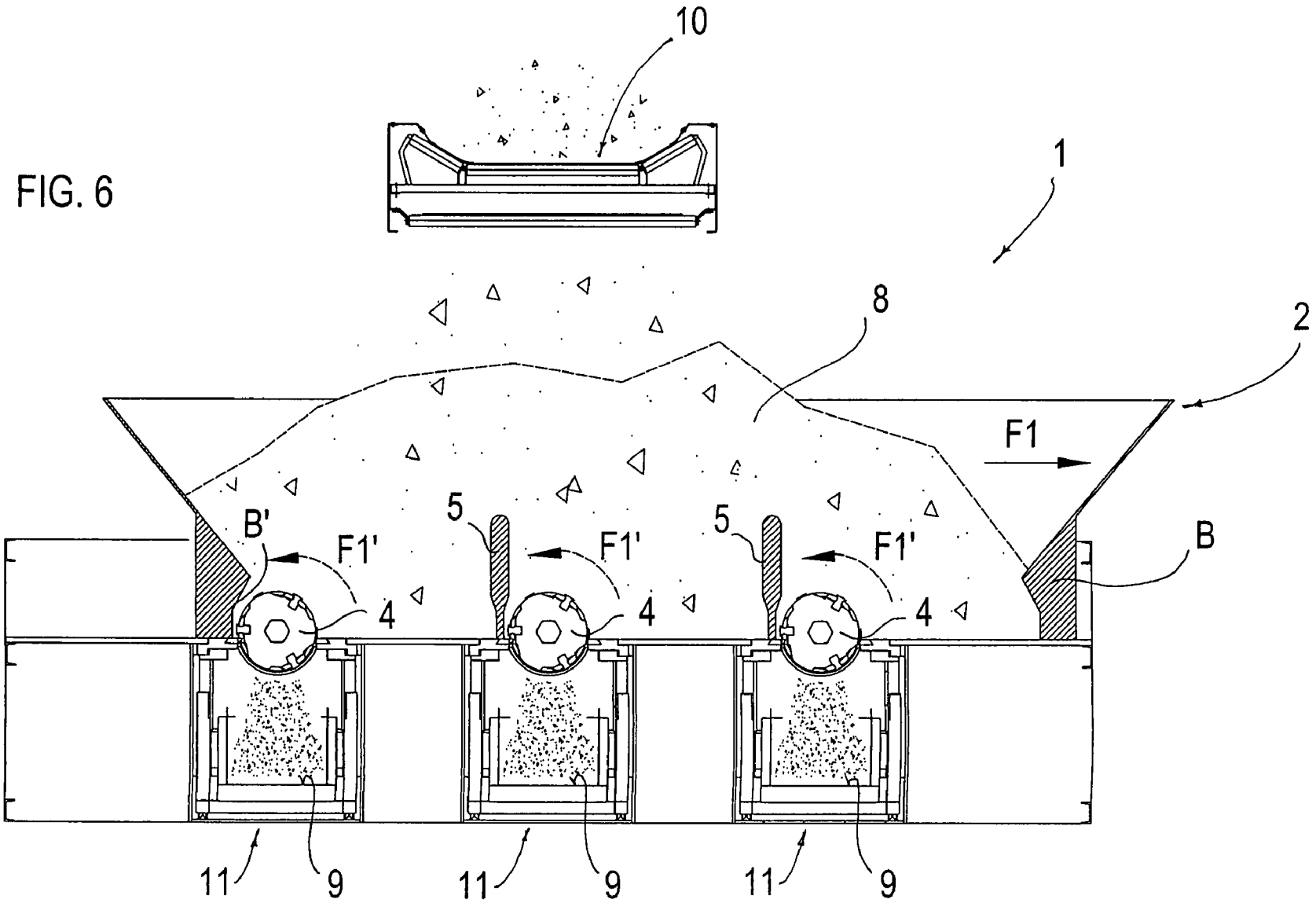
FIG. 6 shows diagrammatically the shredder of FIG. 5 sectioned along the plane A-A of FIG. 1.

In FIGS. 4 and 6 the material 8 shredded by each shredding unit 11 is removed by a conveyor belt 9 placed beneath the shredding unit 11: the conveyor belts 9 can be omitted without departing from the scope of the invention.

When the hopper 2 has ended its translation in the direction of the arrow F (FIGS. 3 and 4), its movement is reversed and, at the same time, the direction of rotation of the rotors 4 is reversed: the vanes 5 and the end wall B' of the hopper 2, opposite the wall B, still press the material 8 to be shredded against the rotors 4 (FIG. 6), which still rotate in the opposite direction to the translational movement of the hopper 2 to grip the material 8 and to cut it against the counter-blades.

FIG. 5 and FIG. 6 (which shows diagrammatically the shredder 1 of FIG. 5 sectioned along the plane A-A of FIG. 1) show diagrammatically the shredder 1 of FIG. 1 with the hopper 2 that, by translating in the direction indicated by the arrow F1, has reached the other end of its translational movement.

In FIGS. 5 and 6 the direction of rotation of the rotors is indicated by the arrows F1'.

Figure 7:
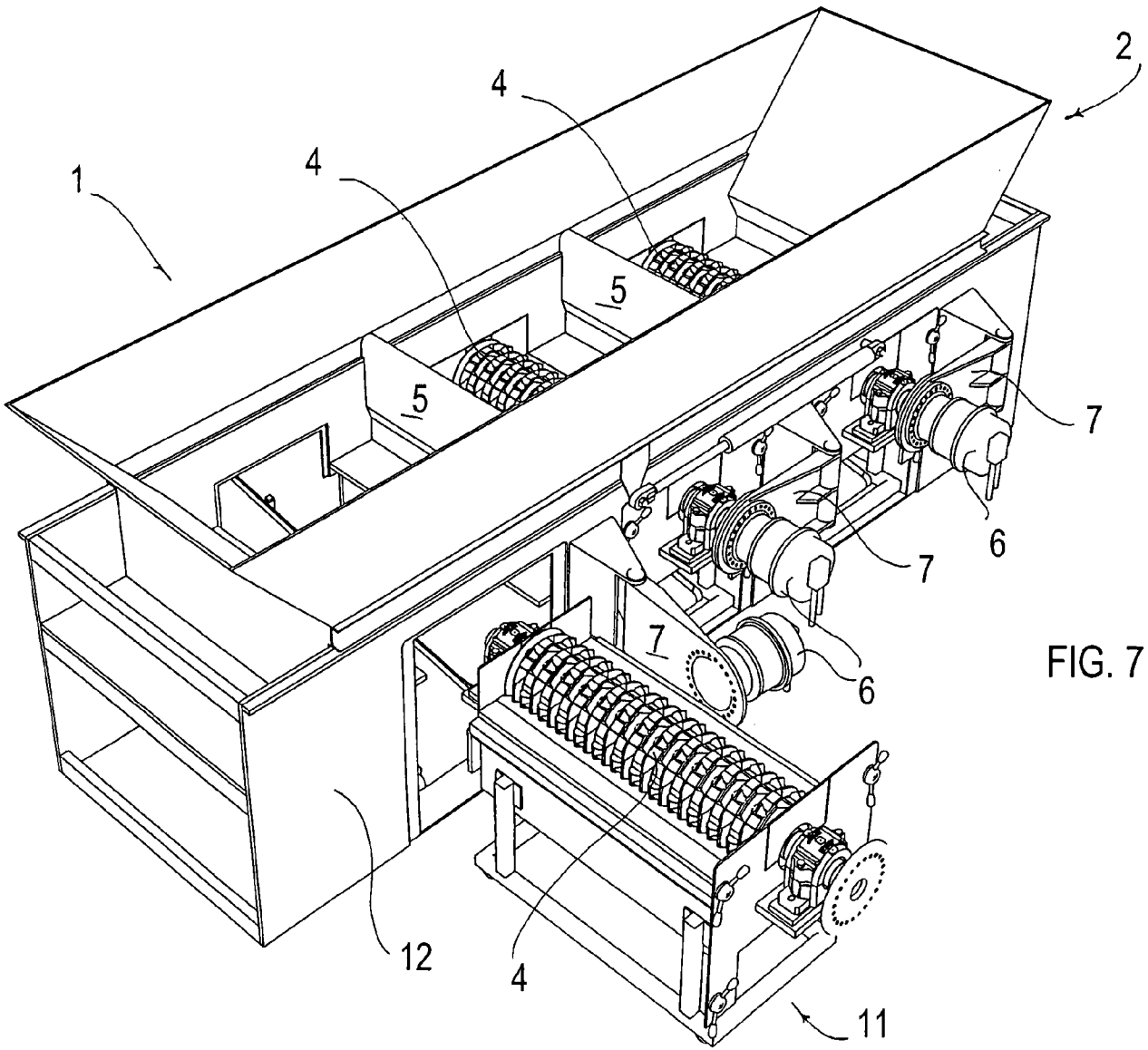
FIG. 7 shows diagrammatically a perspective view of the shredder of FIG. 1, with one of the rotors uncoupled from the respective motor and removed from the loading chamber.

FIG. 7 shows diagrammatically a perspective view of the shredder 1 of FIG. 1, with one of the shredder units 11 uncoupled from the respective motor 6 and extracted sideways from the loading chamber 3 to be replaced easily and rapidly, without being obliged to put the whole shredder 1 out of service for a long time.

In fact, it is sufficient to uncouple the rotor 4 from the motor 6, to rotate the means 7 which carry the motor 6 into a "feathered" position, to remove the locking means (per se known) of the unit 11 to be repaired or maintained, to slide it out of the loading chamber 3, to replace it with another unit 11, to lock it in place by means of the locking means, to couple the rotor 4 to the motor 6 and to put the shredder 1 into operation again.

Figure 8:
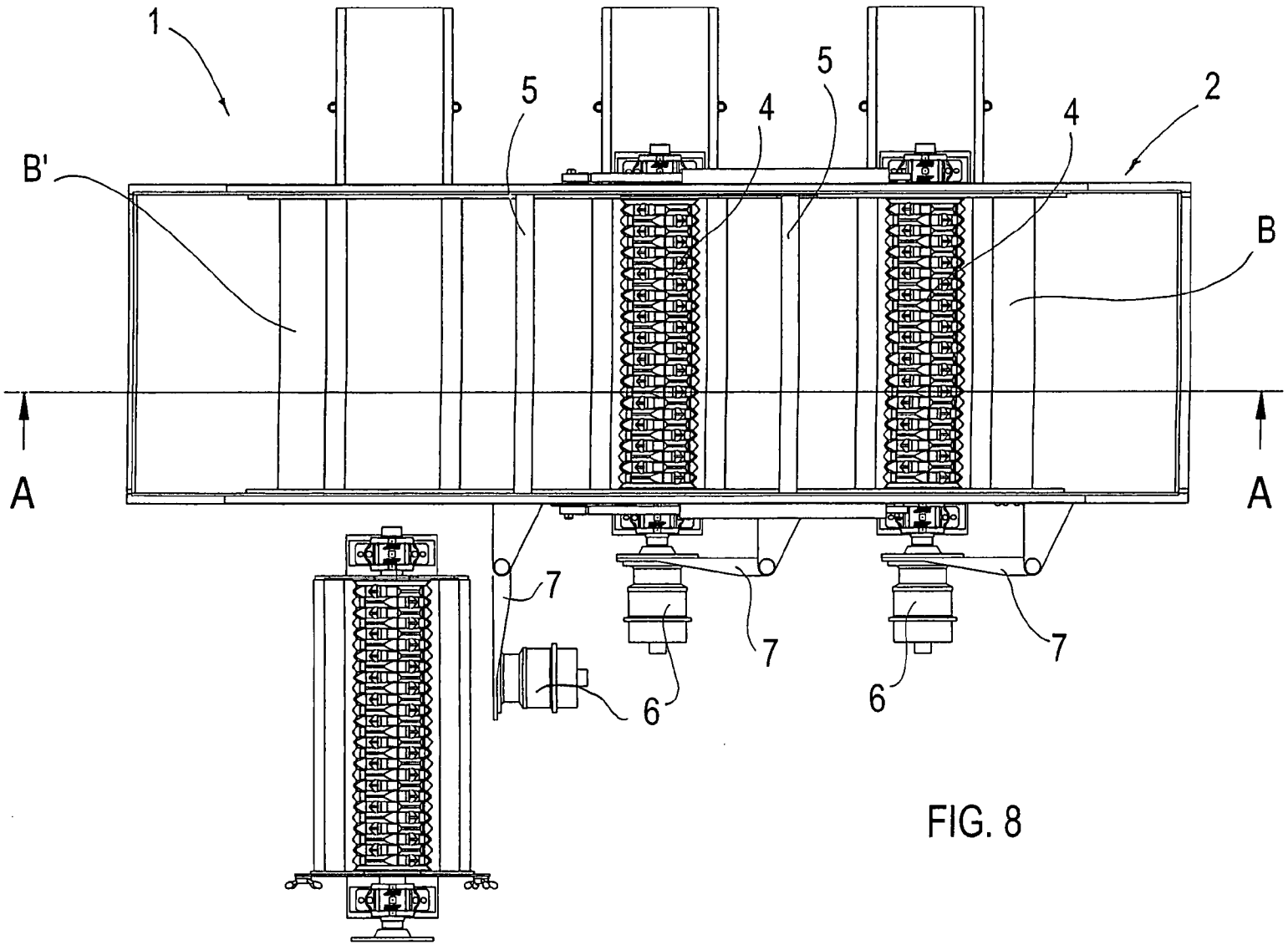
FIG. 8 shows diagrammatically a top view of the shredder of FIG. 7.

FIG. 8 shows diagrammatically a top view of the shredder 1 of FIG. 7; visible in FIG. 8 are the hopper 2, the end walls (B, B'), the vanes 5, the unit 11 removed from the loading chamber 3, the related motor 6 carried in a "feathered" position by the means 7 and the other units 11 with their respective rotors 4 connected to the motors 6.

As is obvious to a person skilled in the art and as has been verified experimentally by the Applicant, throughputs being equal, it is advantageous to replace a machine of the prior art comprising a single rotor (having a single working direction of the rotation) with a machine according to the invention, comprising two or more rotors (having two working directions of rotation) having a smaller power per unit, since:

- the necessary throughput is obtained by summing the individual throughputs of the various shredding units which, because of their limited size, have reduced rotor diameters with limited moments of inertia and thus with a greater ability to withstand sudden stoppages due, for example, to the presence of hard, unshreddable foreign bodies without damages to the rotor shaft and/or to the individual cutting edges;
- the feeding by means of the hopper 2 provided with a reciprocating movement and the operation by reversing the direction of rotation of the rotors allow the down times normally present in the single-rotor machines to be eliminated;
- the presence of the interchangeable modular units 11 allows any modular unit 11 that is damaged or that in any case requires maintenance to be replaced in very short times and with very low costs for the materials and the machine down times;
- the availability of spare modular units 11 represents a small investment, amply repaid by the technical and economic advantages described above.

Without departing from the scope of the invention, a person skilled in the art can make to the waste shredder previously described all the modifications and the improvements suggested by normal experience and/or by the evolution of the art.

The invention claimed is:

1. A waste shredder (1), characterised in that it comprises at least one supporting structure (12) which carries a loading chamber (3), at least two rotors (4) placed in seats formed in the bottom wall of the loading chamber (3) and a movable hopper (2), sliding above the loading chamber (3) and provided with a reciprocating translational movement, which has two end walls (B, B') and which carries a plurality of stiff vanes (5) placed in the spaces between said rotors (4), the end walls (B, B') of the hopper (2) and the vanes (5) protruding downwards until they skim the bottom of the loading chamber (3) to press the material (8) to be shredded against the rotors (4), which rotate in the opposite direction to the translational movement of the hopper (2).

2. A waste shredder (1) as in claim 1, characterised in that the waste shredder (1) comprises n rotors (4) and n−1 vanes (5), n being a whole number of two or more.

3. A waste shredder (1) as in claim 1, characterised in that the rotors (4) reverse their direction of rotation when the hopper (2) reverses its direction of translation.

4. A waste shredder (1) as in claim 1, characterised in that each rotor (4) is driven by a motor (6).

5. A waste shredder (1) as in claim 4, characterised in that the motor (6) is a hydraulic motor.

6. A waste shredder (1) as in claim 4, characterised in that each motor (6) is carried by supporting means (7) and is coupled to the shaft of one of the rotors (4) by means of fast coupling/uncoupling means.

7. A waste shredder (1) as in claim 1, characterised in that each rotor (4) belongs, together with the counter-blades and with a supporting structure, to a shredding unit (11) that can be extracted sideways from the loading chamber (3).

* * * * *